US011786925B2

(12) United States Patent
Liang

(10) Patent No.: US 11,786,925 B2
(45) Date of Patent: Oct. 17, 2023

(54) DUAL-SPRING ALL-PLASTIC VACUUM PUMP

(71) Applicant: Guangzhou Shanggong Plastic Co.,Ltd, Guangzhou (CN)

(72) Inventor: Qiquan Liang, Guangzhou (CN)

(73) Assignee: Guangzhou Shanggong Plastic Co., Ltd, Guangzhou (CN)

( * ) Notice: Subject to any disclaimer, the term of this patent is extended or adjusted under 35 U.S.C. 154(b) by 0 days.

(21) Appl. No.: 17/416,535

(22) PCT Filed: Oct. 29, 2020

(86) PCT No.: PCT/CN2020/124891

§ 371 (c)(1),
(2) Date: Jun. 21, 2021

(87) PCT Pub. No.: WO2022/082844

PCT Pub. Date: Apr. 28, 2022

(65) Prior Publication Data

US 2023/0264218 A1 Aug. 24, 2023

(30) Foreign Application Priority Data

Oct. 23, 2020 (CN) ..... 202011145195.0

(51) Int. Cl.
*B05B 11/00* (2023.01)
*B05B 11/10* (2023.01)

(52) U.S. Cl.
CPC ..... *B05B 11/1077* (2023.01); *B05B 11/1074* (2023.01)

(58) Field of Classification Search
CPC ..... B05B 11/1073; B05B 11/1074; B05B 11/1077
See application file for complete search history.

(56) References Cited

U.S. PATENT DOCUMENTS 4,079,865 A * 3/1978 Kutik ..... B05B 11/1015 222/321.9
4,245,967 A * 1/1981 Busselet ..... B05B 11/1025 417/510

(Continued)

FOREIGN PATENT DOCUMENTS

CN 1136526 A 11/1996
CN 2527528 Y 12/2002

(Continued)

*Primary Examiner* — Paul R Durand
*Assistant Examiner* — Randall A Gruby

(57) ABSTRACT

The disclosure discloses a dual-spring all-plastic vacuum pump which includes a base and a pressing head. A feeding hole is formed in a bottom of the base, an accommodating cavity is defined by assembly of the pressing head and the base, the feeding hole is in communication with the accommodating cavity, and a limiting cover, a plastic one-way spring, a discharging member and a plastic reset spring are disposed in the accommodating cavity. The limiting cover surrounds the feeding hole, a guide hole in a top of the limiting cover is in communication with an interior of the limiting cover, the plastic one-way spring is clamped between the base and the limiting cover, a fixed end of the plastic one-way spring is in connection and communication with the feeding hole, a stressed end of the plastic one-way spring is in communication with the guide hole, and the fixed end and the stress are opposite. The discharging member is disposed between the pressing head and the limiting cover, the discharging member penetrates through the guide hole and is in communication with the stressed end, and the discharging member is configured to receive materials to the pressing head for output. The plastic reset spring is clamped between the discharging member and the limiting cover. Pressing of the pressing head is configured to push the discharging member to compress the plastic one-way spring. By means of the solution, a metal spring is (Continued)

replaced with a plastic spring, and the problem that an existing pump head is inconvenient to directly recycle is practically solved.

10 Claims, 2 Drawing Sheets

(56) References Cited

U.S. PATENT DOCUMENTS

| | | | | | |
|---|---|---|---|---|---|
| 5,038,965 | A * | 8/1991 | Cater | B05B 11/1074 | 222/321.2 |
| 5,217,148 | A * | 6/1993 | Cater | B05B 11/0037 | 222/321.2 |
| 5,638,996 | A * | 6/1997 | Montaner | B05B 11/1097 | 222/321.2 |
| 5,655,688 | A * | 8/1997 | Moore | B05B 11/1004 | 222/321.2 |
| 6,036,059 | A * | 3/2000 | VanBrocklin | B05B 11/1025 | 222/321.9 |
| 7,735,693 | B2 * | 6/2010 | Pares | B05B 11/1007 | 222/321.2 |
| 10,434,531 | B2 * | 10/2019 | Goettke | B65D 43/0214 | |
| 10,661,938 | B2 * | 5/2020 | Elmeguenni | B65D 1/32 | |
| 10,753,485 | B2 * | 8/2020 | Kang | B05B 11/1069 | |
| 11,097,292 | B2 * | 8/2021 | Chevalier | B05B 1/3442 | |
| 11,154,888 | B2 * | 10/2021 | Lee | B05B 11/1025 | |
| 2004/0000567 | A1 * | 1/2004 | Greiner-Perth | B05B 11/1092 | 222/321.9 |
| 2021/0187530 | A1 * | 6/2021 | Lee | B05B 1/3447 | |

FOREIGN PATENT DOCUMENTS

| | | | |
|---|---|---|---|
| CN | 202987798 | U | 6/2013 |
| CN | 104071437 | A | 10/2014 |
| CN | 105173425 | A | 12/2015 |
| CN | 105947389 | A | 9/2016 |
| CN | 207985641 | U | 10/2018 |
| CN | 211663799 | U | 10/2020 |
| FR | 2954293 | A1 | 6/2011 |
| JP | 2018015685 | A | 2/2018 |

* cited by examiner

DUAL-SPRING ALL-PLASTIC VACUUM PUMP

TECHNICAL FIELD

The disclosure relates to the field of pump heads, in particular to a dual-spring all-plastic vacuum pump.

BACKGROUND ART

In daily life, paste materials are usually stored by a hose. The hose includes a pump head and a bottle body made of plastic. Although the pump body is also basically made of plastic, because a spring in the pump head is made of metal, the pump head and the bottle body need to be respectively recycled when recycled, and cannot be treated together, which causes great trouble to recycling of the hose, and therefore a technical means capable of solving the problem is urgently needed.

SUMMARY OF THE DISCLOSURE

The objective of the disclosure is to provide a dual-spring all-plastic vacuum pump to solve the problem that an existing pump head is inconvenient to directly recycle.

In order to solve the above technical problem, the disclosure provides a dual-spring all-plastic vacuum pump including a base and a pressing head. A feeding hole is formed in a bottom of the base, and an accommodating cavity is defined by assembly of the pressing head and the base. The feeding hole is in communication with the accommodating cavity, and a limiting cover, a plastic one-way spring, a discharging member and a plastic reset spring are disposed in the accommodating cavity. The limiting cover surrounds the feeding hole, a top of the limiting cover is provided with a guide hole, and the guide hole is in communication with an interior of the limiting cover. The plastic one-way spring is clamped between the base and the limiting cover. Two opposite ends of the plastic one-way spring are a fixed end and a stressed end respectively. The fixed end and the stressed end are in communication with each other, the fixed end is in connection and communication with the feeding hole, and the stressed end is in communication with the guide hole. The discharging member is disposed between the pressing head and the limiting cover, the discharging member penetrates through the guide hole and is in communication with the stressed end, and the discharging member is configured to receive materials to the pressing head for output. The plastic reset spring is clamped between the discharging member and the limiting cover. Pressing of the pressing head is configured to push the discharging member to compress the plastic one-way spring.

In one embodiment, the discharging member includes a discharging tube and a positioning cover. The discharging tube penetrates through the guide hole to be inserted into the plastic one-way spring. The discharging tube is hollow internally to form a discharging channel, and the discharging channel is in communication with an interior of the plastic one-way spring. The positioning cover surrounds a periphery of an end of the discharging tube. An annular groove is defined by the positioning cover and an outer wall of the discharging tube, and one end of the plastic reset spring is embedded into the annular groove.

In one embodiment, a top face of the limiting cover is provided with a circle of convex ring. The convex ring surrounds the guide hole, and one end of the plastic reset spring surrounds the convex ring.

In one embodiment, a connector is further disposed in the accommodating cavity, and the connector includes a cover body portion and a tube body portion connected to each other. The cover body portion is disposed in the limiting cover. The stressed end is disposed in the cover body portion, and the stressed end abuts against the cover body portion. The tube body portion penetrates through the guide hole to sleeve the discharging tube.

In one embodiment, a position, connected to an interior of the cover body portion, of the tube body portion is provided with a limiting wall narrowed inwards. A space defined by the limiting wall is in communication with the plastic one-way spring and the discharging channel, and a smallest diameter of the limiting wall is smaller than an outer diameter of the discharging tube.

In one embodiment, the discharging tube includes a feeding section and a discharging section connected to each other. An outer wall of a port of the discharging section is provided with the positioning cover, and an outer tube diameter of the discharging section is larger than an inner tube diameter of the tube body portion.

In one embodiment, a bearing ring is disposed inside the cover body portion. The bearing ring is embedded into the stressed end, and the stressed end is clamped between a space defined by the bearing ring and the cover body portion.

In one embodiment, a first annular positioning groove is disposed in an inner surface of a bottom of the base. The first annular positioning groove surrounds the feeding hole, and the fixed end is embedded into the first annular positioning groove.

In one embodiment, a second annular positioning groove is further disposed in the inner surface of the bottom of the base. The second annular positioning groove surrounds the first annular positioning groove, and a lower portion of the limiting cover is embedded into the second annular positioning groove.

In one embodiment, the dual-spring all-plastic vacuum pump further includes an outer cover, and the outer cover detachably sleeves the pressing head.

The disclosure has the following beneficial effects:

Because the limiting cover, the plastic one-way spring, the discharging member and the plastic reset spring are disposed in the accommodating cavity, a metal spring is replaced with the plastic one-way spring and the plastic reset spring according to this solution. A pump head can be subjected to unified treatment when recycled, and therefore the problem that an existing pump head is inconvenient to directly recycle is practically solved.

BRIEF DESCRIPTION OF THE DRAWINGS

To describe the technical solutions of the disclosure more clearly, the following briefly describes accompanying drawings required for describing the embodiments. Apparently, the following described accompanying drawings are only some of the embodiments of the disclosure, and those of ordinary skill in the art may still derive other drawings from these accompanying drawings without creative efforts.

Figure 1:
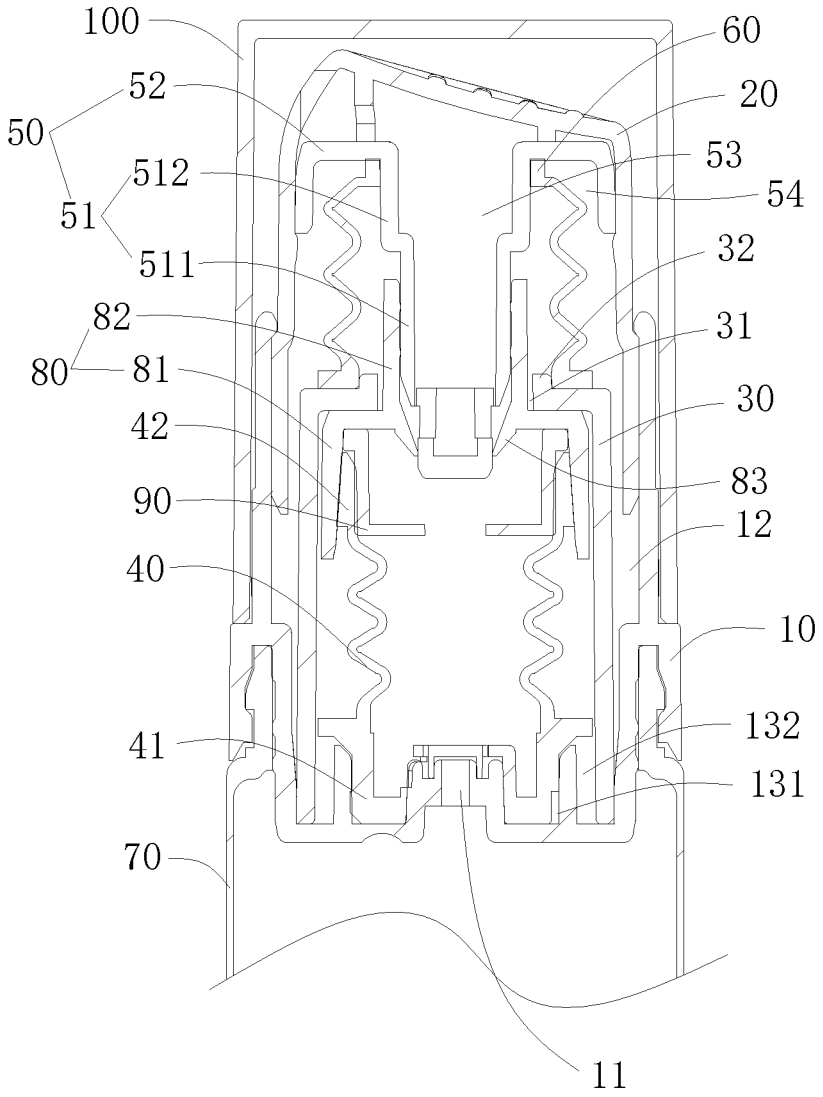
FIG. 1 is a schematic partial cross-sectional structural diagram provided by an embodiment of a dual-spring all-plastic vacuum pump of the disclosure.

Reference numerals are as follows:

10, base; 11, feeding hole; 12, accommodating cavity; 131, first annular positioning groove; 132, second annular positioning groove;
20, pressing head;
30, limiting cover; 31, guide hole; 32 convex ring;
40, plastic one-way spring; 41 fixed end; 42, stressed end;
50, discharging member; 51, discharging pipe; 511, feeding section; 512, discharging section; 52, positioning cover; 53, discharging channel; 54 annular groove;
60, plastic reset spring;
70, bottle body;
80, connector; 81, cover body portion; 82 tube body portion; 83, limiting wall;
90, bearing ring;
100, outer cover.

DETAILED DESCRIPTION OF THE DISCLOSURE

The following clearly and completely describes the technical solutions in the implementations of the disclosure with reference to the accompanying drawings in the implementations of the disclosure.

Figure 2:
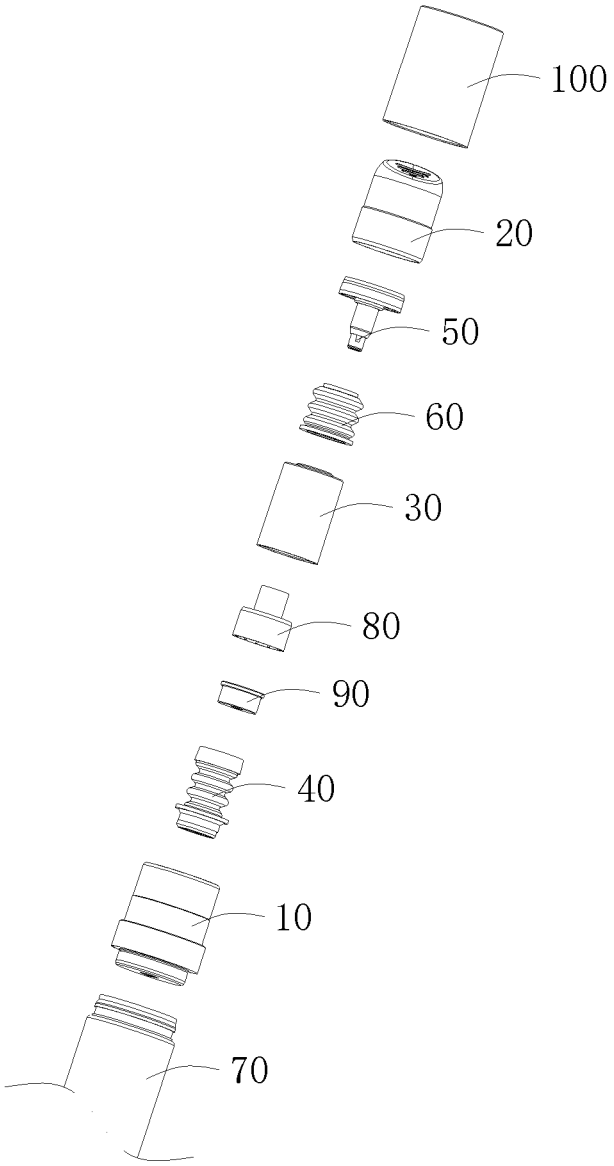
FIG. 2 is a schematic disassembly structural diagram provided by an embodiment of a dual-spring all-plastic vacuum pump of the disclosure.

The disclosure provides a dual-spring all-plastic vacuum pump, and an embodiment thereof is shown in FIG. 1 and FIG. 2, including a base 10 and a pressing head 20. A feeding hole 11 is formed in a bottom of the base 10, and an accommodating cavity 12 is defined by assembly of the pressing head 20 and the base 10. The feeding hole 11 is in communication with the accommodating cavity 12, and a limiting cover 30, a plastic one-way spring 40, a discharging member 50 and a plastic reset spring 60 are disposed in the accommodating cavity 12. The limiting cover 30 surrounds the feeding hole 11, a top of the limiting cover 30 is provided with a guide hole 31, and the guide hole 31 is in communication with an interior of the limiting cover 30. The plastic one-way spring 40 is clamped between the base 10 and the limiting cover 30. Two opposite ends of the plastic one-way spring 40 are a fixed end 41 and a stressed end 42 respectively. The fixed end 41 and the stressed end 42 are in communication with each other, the fixed end 41 is in connection and communication with the feeding hole 11, and the stressed end 42 is in communication with the guide hole 31. The discharging member 50 is disposed between the pressing head 20 and the limiting cover 30, the discharging member 50 penetrates through the guide hole 31 and is in communication with the stressed end 42, and the discharging member 50 is configured to receive materials to the pressing head 20 for output. The plastic reset spring 60 is clamped between the discharging member 50 and the limiting cover 30. Pressing of the pressing head 20 is configured to push the discharging member 50 to compress the plastic one-way spring 40.

During application, the dual-spring all-plastic vacuum pump and the bottle body 70 are assembled for use. At the moment, the bottle body 70 is fixedly connected to the base 10, and the interior of the bottle body 70 is used to store materials. If a user presses the pressing head 20, the discharging member 50 will press the plastic one-way spring 40 and the plastic reset spring 60, so that the plastic one-way spring 40 and the plastic reset spring 60 are in a contracted state, and materials in the plastic one-way spring 40 will be conveyed to the pressing head 20 through the discharging member 50 for discharge. After the user no longer presses the pressing head 20, the plastic one-way spring 40 will automatically restore an original shape, and due to the change of air pressure, the plastic one-way spring 40 also will automatically extract materials from the bottle body 70 until the materials fill the interior of the plastic one-way spring 40 fully, and the plastic reset spring 60 also will automatically restore an original shape. Therefore, the pressing head 20 is pushed back to an original position.

Therefore, with this solution, a metal spring is replaced with the plastic one-way spring 40 and the plastic reset spring 60. When recycled, a pump head can be subjected to unified treatment, and therefore the problem that an existing pump head is inconvenient to directly recycle is solved.

As shown in FIG. 1, the discharging member 50 includes a discharging tube 51 and a positioning cover 52. The discharging tube 51 penetrates through the guide hole 31 to be inserted into the plastic one-way spring 40. The discharging tube 51 is hollow internally to form a discharging channel 53, and the discharging channel 53 is in communication with the interior of the plastic one-way spring 40. The positioning cover 52 surrounds a periphery of an end of the discharging tube 51, and an annular groove 54 is defined by the positioning cover 52 and an outer wall of the discharging tube 51. One end of the plastic reset spring 60 is embedded into the annular groove 54.

After the structure is adopted, the materials in the plastic one-way spring 40 can be conveyed to the pressing head 20 through the discharging channel 53 for discharge, and the annular groove 54 also realizes fixing at an upper mounting position of the plastic reset spring 60, so that working stability of the plastic reset spring 60 is guaranteed.

As shown in FIG. 1, a top face of the limiting cover 30 is provided with a circle of convex ring 32. The convex ring 32 surrounds the guide hole 31, and one end of the plastic reset spring 60 surrounds the convex ring 32.

After the structure is adopted, the convex ring 32 realizes fixing at a lower mounting position of the plastic reset spring 60, so that working stability of the plastic reset spring 60 is further improved.

As shown in FIG. 1, a connector 80 is further disposed in the accommodating cavity 12. The connector 80 includes a cover body portion 81 and a tube body portion 82 connected to each other. The cover body portion 81 is disposed in the limiting cover 30. The stressed end 42 is disposed in the cover body portion 81, and the stressed end 42 abuts against the cover body portion 81. The tube body portion 82 penetrates through the guide hole 31 to sleeve the discharging tube 51.

That is, after the user presses the pressing head 20, the discharging member 50 can drive the connector 80 to move downwards together, whereby downward pressure is applied to the plastic one-way spring 40 through the connector 80, such that compression control over the plastic one-way spring 40 is realized. After the user no longer presses the pressing head 20, the plastic one-way spring 40 will drive the connector 80 to reset together.

As shown in FIG. 1, a position, connected to an interior of the cover body portion 81, of the tube body portion 82 is provided with a limiting wall 83 narrowed inwards. A space defined by the limiting wall 83 is in communication with the plastic one-way spring 40 and the discharging channel 53, and a smallest diameter of the limiting wall 83 is smaller than an outer diameter of the discharging tube 51.

At the moment, the limiting wall 83 substantially defines an inverted cone shape, so that when the discharging pipe 51 moves downward, the discharging pipe 51 will abut against the limiting wall 83 to push the connector 80 to move downwards.

As shown in FIG. 1, the discharging tube 51 includes a feeding section 511 and a discharging section 512 connected to each other. An outer wall of a port of the discharging section 512 is provided with the positioning cover 52, and an outer tube diameter of the discharging section 512 is larger than an inner tube diameter of the tube body portion 82.

That is, with downward movement of the discharging tube 51, the discharging section 512 will abut against the tube body portion 82, so that the discharging tube 51 is limited from continuing to move downwards, and the phenomenon that the discharging tube cannot be reset due to excessive downward movement is avoided.

As shown in FIG. 1, a bearing ring 90 is disposed inside the cover body portion 81. The bearing ring 90 is embedded into the stressed end 42, and the stressed end 42 is clamped between a space defined by the bearing ring 90 and the cover body portion 81.

Because the space defined by the bearing ring 90 and the cover body portion 81 is small, the two can stably clamp the plastic one-way spring 40 to prevent the plastic one-way spring 40 from producing unstable deformation, and therefore stable compression and reset of the plastic one-way spring 40 is guaranteed.

As shown in FIG. 1, a first annular positioning groove 131 is disposed in an inner surface of a bottom of the base 10, the first annular positioning groove 131 surrounds the feeding hole 11, and the fixed end 41 is embedded into the first annular positioning groove 131. A second annular positioning groove 132 is further disposed in the inner surface of the bottom of the base 10. The second annular positioning groove 132 surrounds the first annular positioning groove 131, and a lower portion of the limiting cover 30 is embedded into the second annular positioning groove 132. By adopting this way, mounting stability of the plastic one-way spring 40 and the limiting cover 30 will be improved.

As shown in FIG. 1, the dual-spring all-plastic vacuum pump further includes an outer cover 100, and the outer cover 100 detachably sleeves the pressing head 20. That is, when in use, the outer cover 100 is removed, and when not in use, the outer cover 100 sleeves the pressing head for protection, so that materials are prevented from being oxidized.

The above mentioned are preferred implementations of the disclosure. It should be noted that several improvements and refinements may be made by those of ordinary skill in the art without departing from the principles of the disclosure, and these improvements and refinements are also to be considered within the scope of the disclosure.

The invention claimed is:

1. A dual-spring all-plastic vacuum pump, comprising a base and a pressing head, wherein a feeding hole is formed in a bottom of the base, an accommodating cavity is defined by assembly of the pressing head and the base, the feeding hole is in communication with the accommodating cavity, and a limiting cover, a plastic one-way spring, a discharging member and a plastic reset spring are disposed in the accommodating cavity;

the limiting cover surrounds the feeding hole, a top of the limiting cover is provided with a guide hole, and the guide hole is in communication with an interior of the limiting cover;

the plastic one-way spring is clamped between the base and the limiting cover, two opposite ends of the plastic one-way spring are a fixed end and a stressed end respectively, the fixed end and the stressed end are in communication with each other, the fixed end is in connection and communication with the feeding hole, and the stressed end is in communication with the guide hole;

the discharging member is disposed between the pressing head and the limiting cover, the discharging member penetrates through the guide hole and is in communication with the stressed end, and the discharging member is configured to receive materials to the pressing head for output;

the plastic reset spring is clamped between the discharging member and the limiting cover; and pressing of the pressing head is configured to push the discharging member to compress the plastic one-way spring.

2. The dual-spring all-plastic vacuum pump according to claim 1, wherein the discharging member comprises a discharging tube and a positioning cover;

the discharging tube penetrates through the guide hole to be inserted into the plastic one-way spring, the discharging tube is hollow internally to form a discharging channel, and the discharging channel is in communication with an interior of the plastic one-way spring; and the positioning cover surrounds a periphery of an end of the discharging tube, an annular groove is defined between the positioning cover and an outer wall of the discharging tube, and one end of the plastic reset spring is embedded into the annular groove.

3. The dual-spring all-plastic vacuum pump according to claim 2, wherein a top face of the limiting cover is provided with a circle of convex ring, the convex ring surrounds the guide hole, and one end of the plastic reset spring surrounds the convex ring.

4. The dual-spring all-plastic vacuum pump according to claim 2, wherein a connector is further disposed in the accommodating cavity, and the connector comprises a cover body portion and a tube body portion connected to each other;

the cover body portion is disposed in the limiting cover, the stressed end is disposed in the cover body portion, and the stressed end abuts against the cover body portion; and the tube body portion penetrates through the guide hole to sleeve the discharging tube.

5. The dual-spring all-plastic vacuum pump according to claim 4, wherein a position, connected to an interior of the cover body portion, of the tube body portion is provided with a limiting wall narrowed inwards, a space defined by the limiting wall is in communication with the plastic one-way spring and the discharging channel, and a smallest diameter of the limiting wall is smaller than an outer diameter of the discharging tube.

6. The dual-spring all-plastic vacuum pump according to claim 4, wherein the discharging tube comprises a feeding section and a discharging section connected to each other, an outer wall of a port of the discharging section is provided with the positioning cover, and an outer tube diameter of the discharging section is larger than an inner tube diameter of the tube body portion.

7. The dual-spring all-plastic vacuum pump according to claim 4, wherein a bearing ring is disposed inside the cover body portion, the bearing ring is embedded into the stressed end, and the stressed end is clamped between a space defined by the bearing ring and the cover body portion.

8. The dual-spring all-plastic vacuum pump according to claim 1, wherein a first annular positioning groove is disposed in an inner surface of a bottom of the base, the first annular positioning groove surrounds the feeding hole, and the fixed end is embedded into the first annular positioning groove.

9. The dual-spring all-plastic vacuum pump according to claim 2, wherein a second annular positioning groove is further disposed in an inner surface of a bottom of the base, the second annular positioning groove surrounds the first annular positioning groove, and a lower portion of the limiting cover is embedded into the second annular positioning groove.

10. The dual-spring all-plastic vacuum pump according to claim 1, wherein the dual-spring all-plastic vacuum pump further comprises an outer cover, and the outer cover detachably sleeves the pressing head.

* * * * *